US007093990B2

(12) United States Patent
Berdan, II

(10) Patent No.: US 7,093,990 B2
(45) Date of Patent: Aug. 22, 2006

(54) METHOD AND APPARATUS FOR MANUFACTURING PANEL PRODUCTS INCLUDING A PRINTED SURFACE

(75) Inventor: Clarke Berdan, II, Granville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 81 days.

(21) Appl. No.: 10/826,221

(22) Filed: Apr. 16, 2004

(65) Prior Publication Data

US 2005/0234582 A1 Oct. 20, 2005

(51) Int. Cl.
*B41J 3/407* (2006.01)
*B41J 11/66* (2006.01)
*B26D 5/30* (2006.01)

(52) U.S. Cl. ..... 400/76; 400/621
(58) Field of Classification Search ..... None
See application file for complete search history.

(56) References Cited

U.S. PATENT DOCUMENTS

| | | | | |
|---|---|---|---|---|
| 3,774,016 | A | 11/1973 | Sterns et al. | |
| 4,801,495 | A * | 1/1989 | van der Hoeven | 442/412 |
| 5,119,725 | A | 6/1992 | Okamura | |
| 5,172,326 | A | 12/1992 | Campbell, Jr. et al. | |
| 5,333,111 | A | 7/1994 | Chaiken et al. | |
| 5,383,130 | A | 1/1995 | Kalisiak | |
| 5,412,578 | A | 5/1995 | Takagi et al. | |
| 5,458,062 | A | 10/1995 | Goldberg et al. | |
| 5,663,885 | A | 9/1997 | Stahl | |
| 5,791,215 | A | 8/1998 | Morrison et al. | |
| 5,831,857 | A | 11/1998 | Clarino et al. | |
| 6,173,211 | B1 | 1/2001 | Williams et al. | |
| 6,434,444 | B1 | 8/2002 | Herman, Jr. | |
| 2002/0029706 | A1 | 3/2002 | Dauer | |
| 2003/0041962 | A1 * | 3/2003 | Johnson et al. | 156/266 |
| 2003/0091758 | A1 * | 5/2003 | Osumi et al. | 428/34 |

FOREIGN PATENT DOCUMENTS

| | | | |
|---|---|---|---|
| EP | 1 167 035 | | 1/2002 |
| JP | 2000318389 | A * | 11/2000 |
| JP | 2001232700 | A * | 8/2001 |

OTHER PUBLICATIONS

Machine translation of JP 2001232700 to Kitamura et al. from Japanese Patent Office website.*
Machine translation of JP 2000318389 to Hatori from Japanese Patent Office website.*

* cited by examiner

*Primary Examiner*—Daniel J. Colilla
(74) *Attorney, Agent, or Firm*—Inger H. Eckert; Maria C. Gasaway; Margaret S. Millikin

(57) ABSTRACT

Provided are a method and apparatus for fabricating a panel product including a board, panel or substrate having at least one surface on which a decorative image and alignment marks corresponding to an image data file are applied. The alignment marks and the image data file are then used to align an intermediate product with one or more cutting devices. Once aligned, the original image data file or a transformed version of the image data file is used to control cutters or other tools for removing waste portions of the panel product. The panel product may then be subjected to additional processing, particularly with regard to edge treatments, to obtain a final panel product.

16 Claims, 8 Drawing Sheets

METHOD AND APPARATUS FOR MANUFACTURING PANEL PRODUCTS INCLUDING A PRINTED SURFACE

TECHNICAL FIELD AND INDUSTRIAL APPLICABILITY

The present invention generally relates to methods and associated apparatus for manufacturing panel products, such as acoustical panels, that include a printed surface and, more particularly the integration of printing and cutting operations to form the panel products more precisely and thereby reduce material expense and improve the repeatability of the panel manufacturing process.

BACKGROUND OF THE INVENTION

A number of computerized systems for generating cutting markers for fabric or board materials have been developed for increasing pattern piece density and thereby minimizing the waste of material. More advanced systems have been developed for addressing materials that have distinct patterns of surface topographies, such as embossments, channels, corrugations, or distinct visual patterns such as plaids, stripes, prints or other regularly repeating designs that may require a specific alignment of the patterned portion among two or more pattern pieces to produce an acceptable finished product. Consequently, some pattern piece density is typically sacrificed in order to obtain pattern pieces that will provide the desired design alignment.

With respect to materials including image patterns, particularly those having a regularly repeated design other than stripes or plaids, are produced by printing or transferring the design onto a suitable plain, unprinted material or a cover layer subsequently applied to the bulk material. Although rotary plate and silk-screen printing, or variations thereof, have long been used for this purpose, more recently the use of multiple, minute jets of appropriate inks, dyes or pigments in a process generally analogous to the widely used ink-jet paper printing process has become more common. Like ink-jet printing on paper, the jet printing of the plain material is performed under the control of a computer.

As disclosed in U.S. Pat. No. 6,173,211 B1, a system has been developed for producing fabric pattern pieces in which the fabric design printed on each pattern piece can be arranged in a predetermined manner with respect to the boundaries of the various pieces, thereby reducing waste. As described, the pattern design is printed only within or slightly overlapping the boundaries of the pattern pieces, thereby avoiding the difficulty associated with aligning the various pattern pieces relative to a preprinted repeating design. This allows more compact nesting of the pattern pieces on the work material.

The graphical images corresponding to the repeating portion of the design, may be generated and combined individually with pattern piece templates. The pattern piece templates may then be arranged in a nested relation without regard to the pattern to establish cutting and printing markers that will produce the desired finished pattern pieces. The cutting and printing markers may then be used to control a cutter for cutting the pattern pieces from the base fabric and a printer for printing the desired designs onto the base fabric in those areas that correspond to the pattern pieces.

SUMMARY OF THE INVENTION

The exemplary embodiments of the present invention provide an apparatus and a method for producing acoustical or structural panels having at least one decorative surface.

Exemplary methods for forming decorative panel products will include the steps of preparing a suitable substrate, such as a panel or board; applying a decorative image and alignment marks corresponding to an image data file to at least one surface of the substrate to form a printed substrate; detecting the alignment marks; aligning the printed substrate with a cutting device using the detected alignment marks; and then driving the cutting device using the image data file to produce a panel preform. Exemplary methods may include other finishing processes such as modifying one or more of the edge surfaces of the panel preform to form a finished panel product or providing a protective layer on the decorative image.

The decorative image may be applied to the substrate using one or more of a variety of methods including applying a premanufactured cover layer to at least a portion of a major surface of the substrate and then printing the decorative image and alignment marks corresponding to the image data file on the premanufactured cover layer to form the printed substrate.

Another exemplary embodiment includes applying a primer layer or other surface conditioning treatment to at least a portion of a major surface of the substrate and then printing the decorative image and alignment marks corresponding to the image data file on the primer layer to form the printed substrate. Yet another exemplary embodiment includes applying the decorative image and alignment marks corresponding to the image data file to a premanufactured cover layer to form a printed cover layer and then applying the printed cover layer to the surface of the substrate to form the printed substrate.

As will be appreciated by those of ordinary skill in the art, the decorative image(s) and alignment marks may be applied directly to the substrate, cover layer or primer layer or may be applied through a transfer method wherein a reversed decorative image and reversed alignment marks corresponding to the image data file are applied to a transfer base to form an image layer on the transfer base and then transferred from the transfer base to the cover layer or substrate to form the positive decorative image and alignment marks on the printed cover layer.

The exemplary embodiments of the invention also provide various apparatus for manufacturing decorative panel products that will include means for applying a decorative image and alignment marks corresponding to an image data file to a surface of the substrate to form a printed substrate; means for detecting the alignment marks on the printed substrate; means for aligning the printed substrate with a cutting device using the detected alignment marks; and means for driving the cutting device using the image data file to produce a panel preform from the printed substrate.

Depending on the particular method being practiced, exemplary apparatus according to the present invention may include means for applying a reversed decorative image and reversed alignment marks corresponding to the image data file to a transfer base to form an image layer on a transfer base; means for bringing the image layer into contact with a cover layer; and means for transferring the majority of the image layer from the transfer to the cover layer to form the decorative image and alignment marks on the printed cover layer. Similarly, depending on the alignment method utilized, the apparatus may include means for both gross and fine alignment of the printed substrate relative to the cutting device(s) and/or means for generating one or more transformed image data files that may be used to drive the cutting device(s) without requiring movement of the printed substrate.

BRIEF DESCRIPTION OF THE DRAWINGS

The above and other features and advantages of the present invention will become more apparent by describing in detail preferred embodiments thereof with reference to the attached drawings in which.

These figures are for the purpose of illustration only and are not, therefore, drawn to scale. The relative sizing and orientation of the various structural elements may have been exaggerated, simplified and/or otherwise modified to improve the clarity of the drawings with respect to the written description and should not be interpreted as unduly limiting the scope of the invention.

DETAILED DESCRIPTION OF EXEMPLARY EMBODIMENTS

Figure 1A:
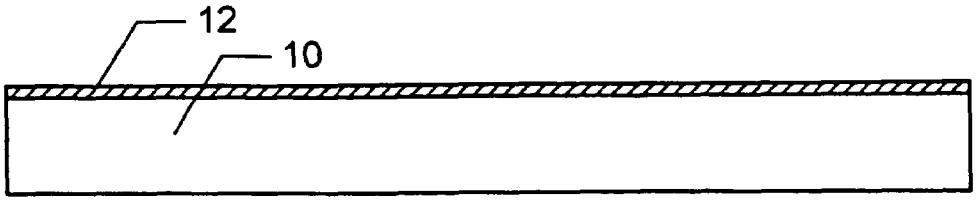
FIGS. 1A–E are cross-sectional views illustrating exemplary embodiments for the configuration of the core board 10 and some of the various materials and layers that may be applied to the board surface.
Figure 1B:
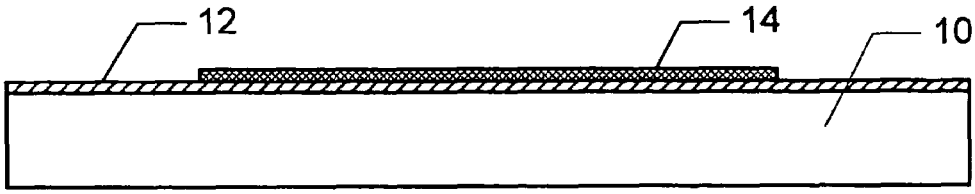
Figure 1C:
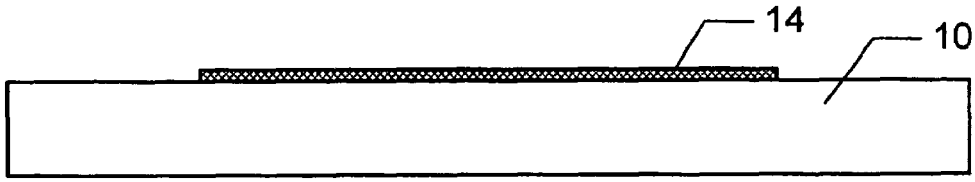

As illustrated in FIG. 1A, the present invention relates to the production of rigid or semi-rigid panel products that include as a major component a board or matt 10 of fibrous or foam materials. The materials may include fibers made from various combinations of minerals to produce glass or other mineral fibers, and/or fibers made from one or more polymeric materials such as polypropylene (PP), polyethylene (PE), polyester, polyethylene terephthalate (PET), nylon, ethylene/vinyl acetate (EVA) or any other polymer or polymer combination suitable for the intended product application. The board 10 may also include one or more binder materials to promote adhesion between adjacent fibers and may be prepared within a wide range of density and openness or porosity depending on the intended product application. The board 10 may also include other additives such as fire retardants, UV stabilizers, filling agents in order to produce a final panel product having a desired combination of properties.

Figure 1D:
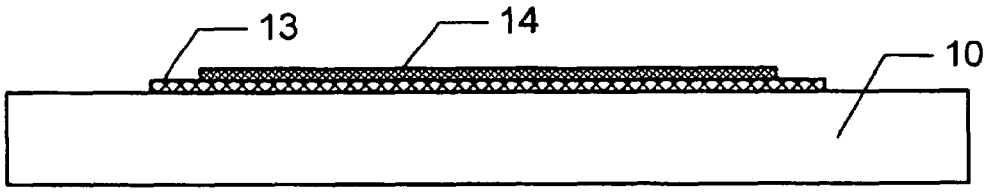
Figure 1E:
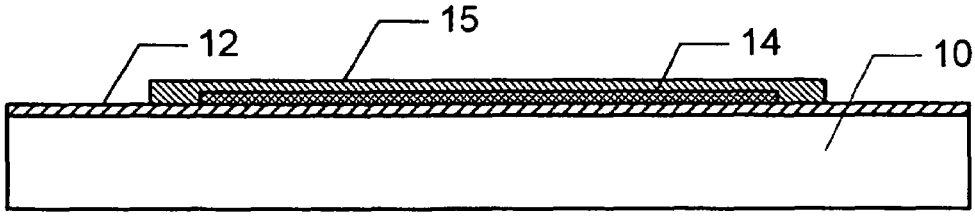

As illustrated in FIGS. 1A–E, the basic board 10 may then be subjected to one or more of a variety of subsequent processing including the application of a premanufactured cover layer 12, FIG. 1A, that may be self-adhesive under the application conditions or may require the use of an adhesive composition, the formation of a primer layer 13, FIG. 1D, the formation of a printed image layer 14, FIGS. 1B–E and the formation of a protective layer 15, FIG. 1E. As reflected in FIGS. 11B–D, depending on the composition and structure of the board 10, the intended product application and/or aesthetic concerns, the printed image may be formed directly on the board 10, on the cover layer 12 or on the primer layer 13. In order to protect the printed image and/or the board 10, a protective layer 15 may be formed over the printed image 14 and typically some additional region of the board surface surrounding the printed image. Similarly, depending on the selection and application of the cover layer 12, the primer layer 13 and/or the protective layer 15, the acoustical properties may be adjusted to improve or shift the acoustical performance of the final panel product.

Figure 2:
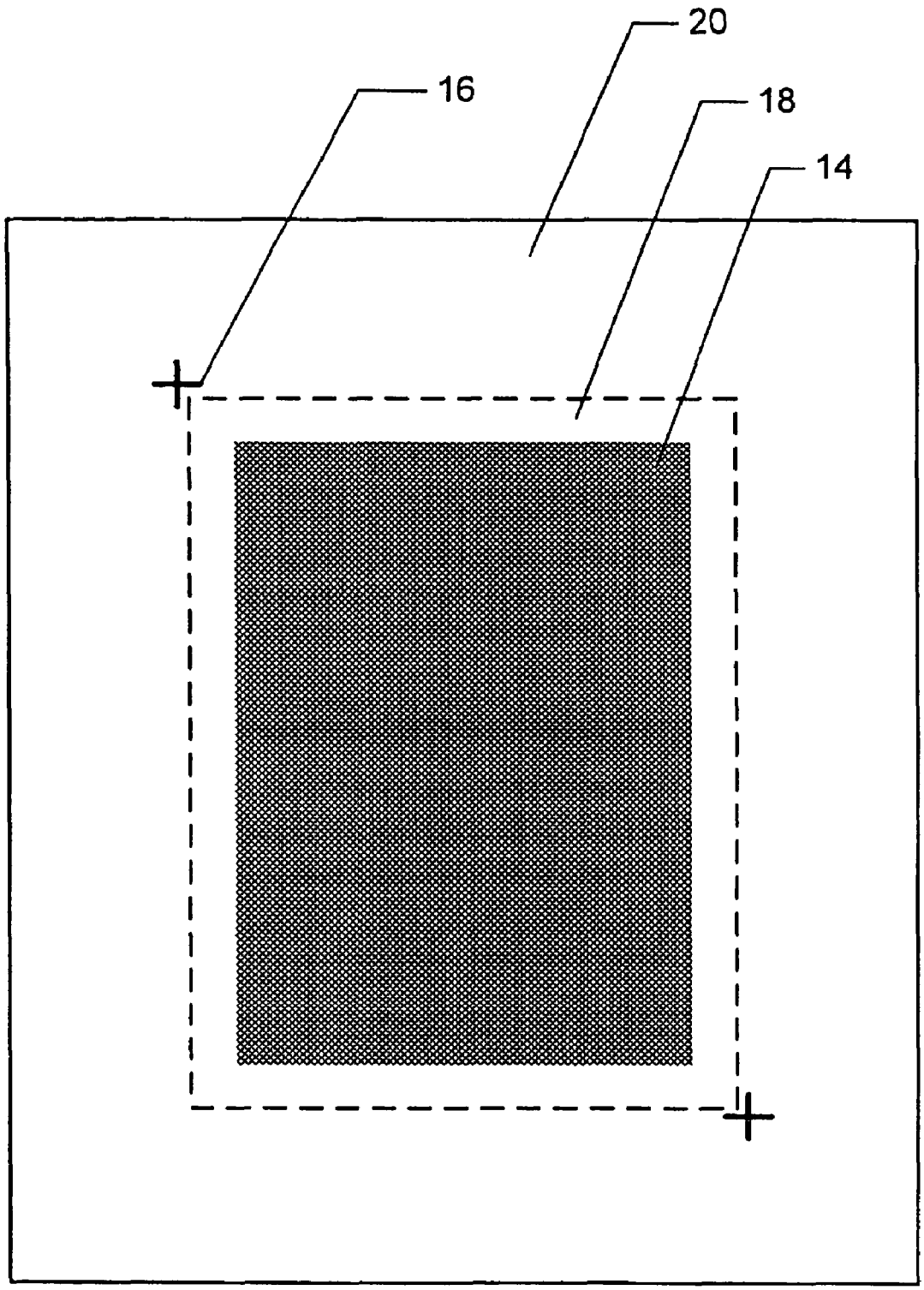
FIG. 2 is a plan view illustrating a decorative surface of a panel generally corresponding to the exemplary embodiment illustrated in FIG. 1B.

As illustrated in FIG. 2, particularly when a cover layer material is utilized, the board 10 and the cover layer 12 material may be cut differently to produce an overlap region 18 that can be used to cover at least a portion of the minor surfaces of the final panel product. Exemplary embodiments of such processes are disclosed in the inventor's previous U.S. patent application Ser. No. 10/749,087 filed Dec. 30, 2003, the disclosure of which is incorporated herein in its entirely by reference.

As further illustrated in FIG. 2, in addition to forming the printed image 14 that will provide a decorative surface on the final panel product, the printing process will also form alignment marks 16 in predetermined regions of the board surface that provide known reference points relative to the main decorative image 14. Depending on the nature of both the alignment marks and decorative image, the alignment marks may be positioned within the periphery of the decorative image 14 (not shown), or, as illustrated, within the overlap region 18 (not shown) or in the waste region 20 that will be removed during subsequent processing.

Figure 3A:
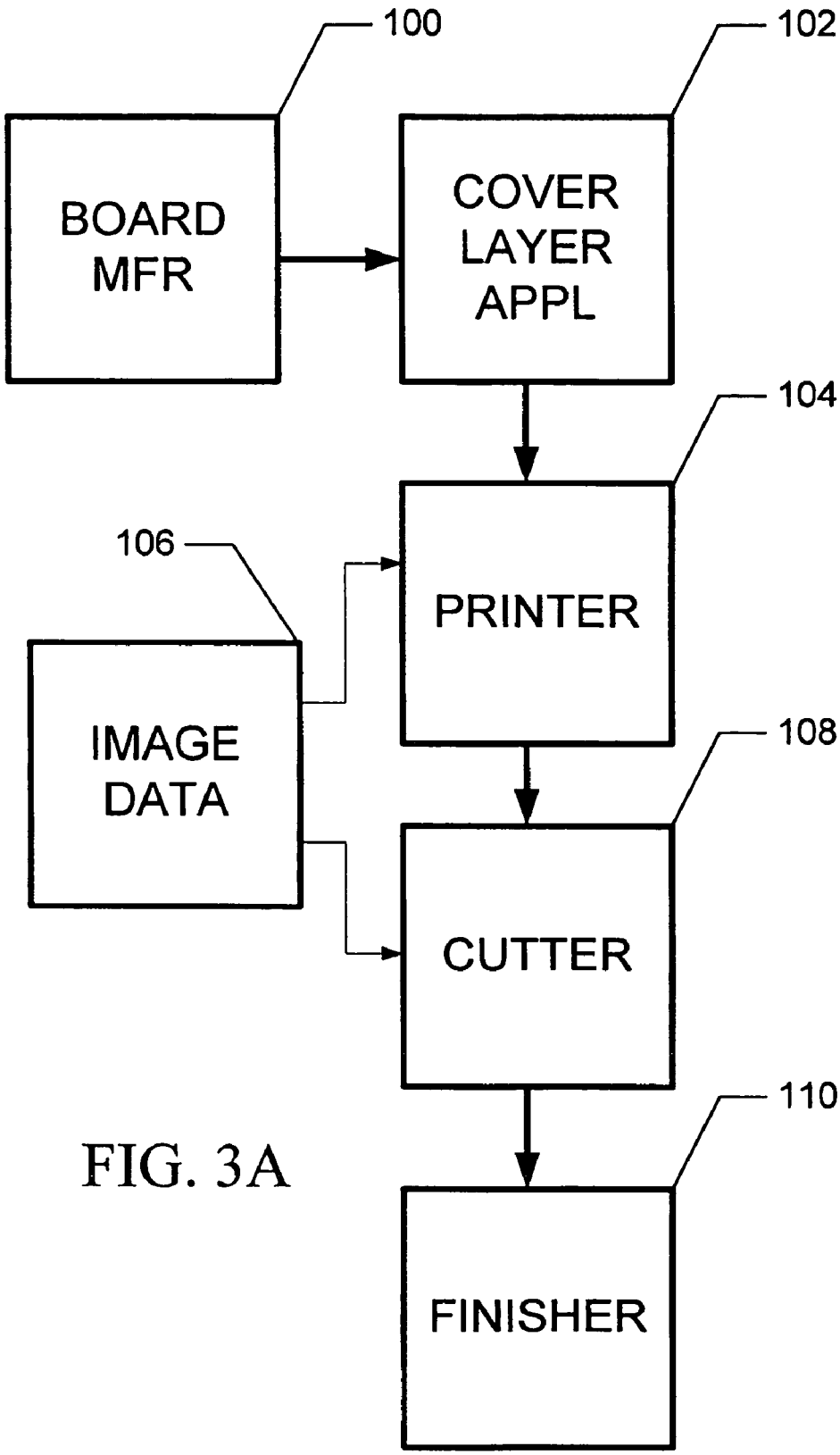
FIGS. 3A–C provide flow charts generally corresponding to particular steps in the production of final panel products generally corresponding to the exemplary embodiments illustrated in FIGS. 1B and 1D.
Figure 3B:
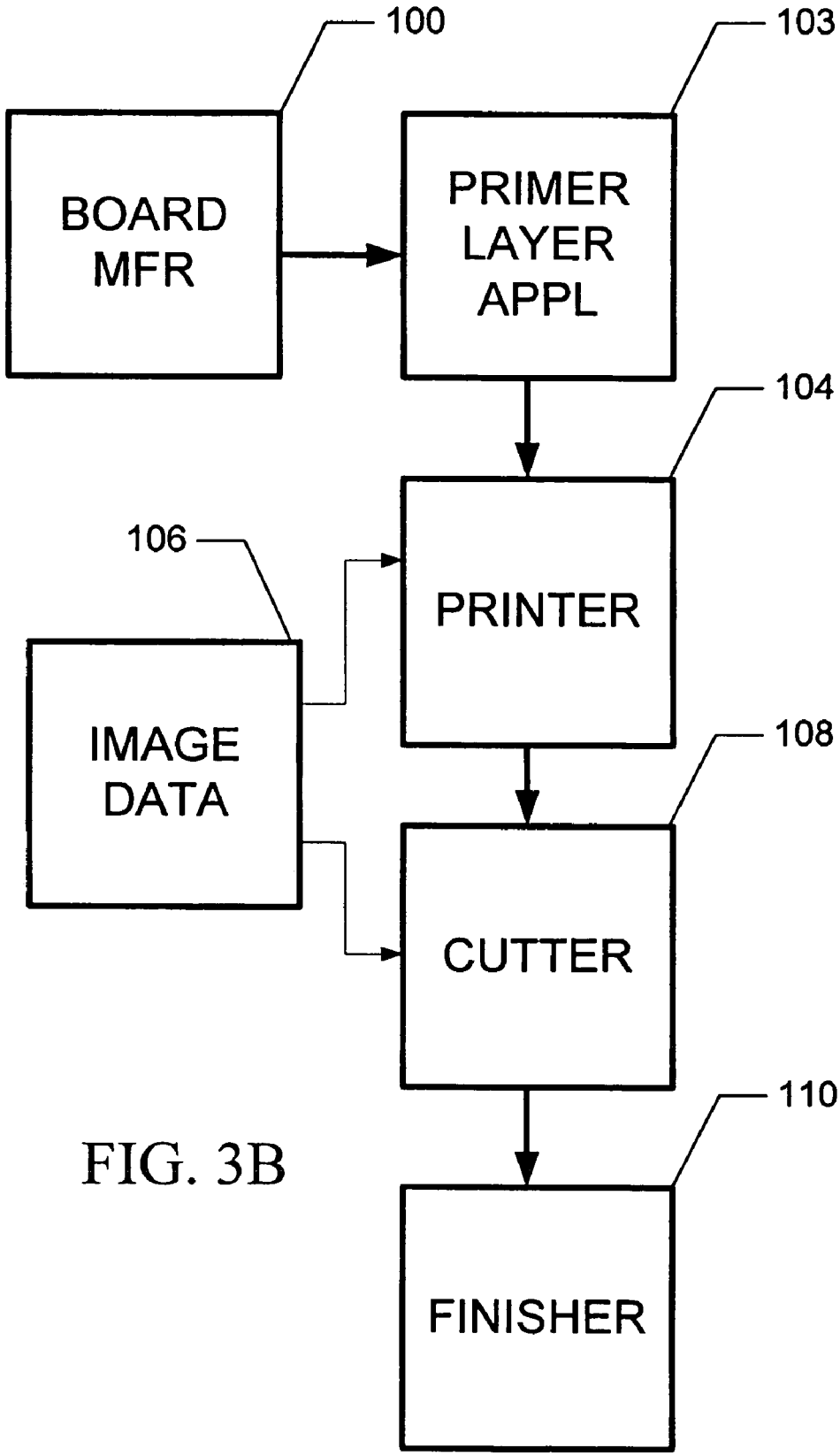
Figure 3C:
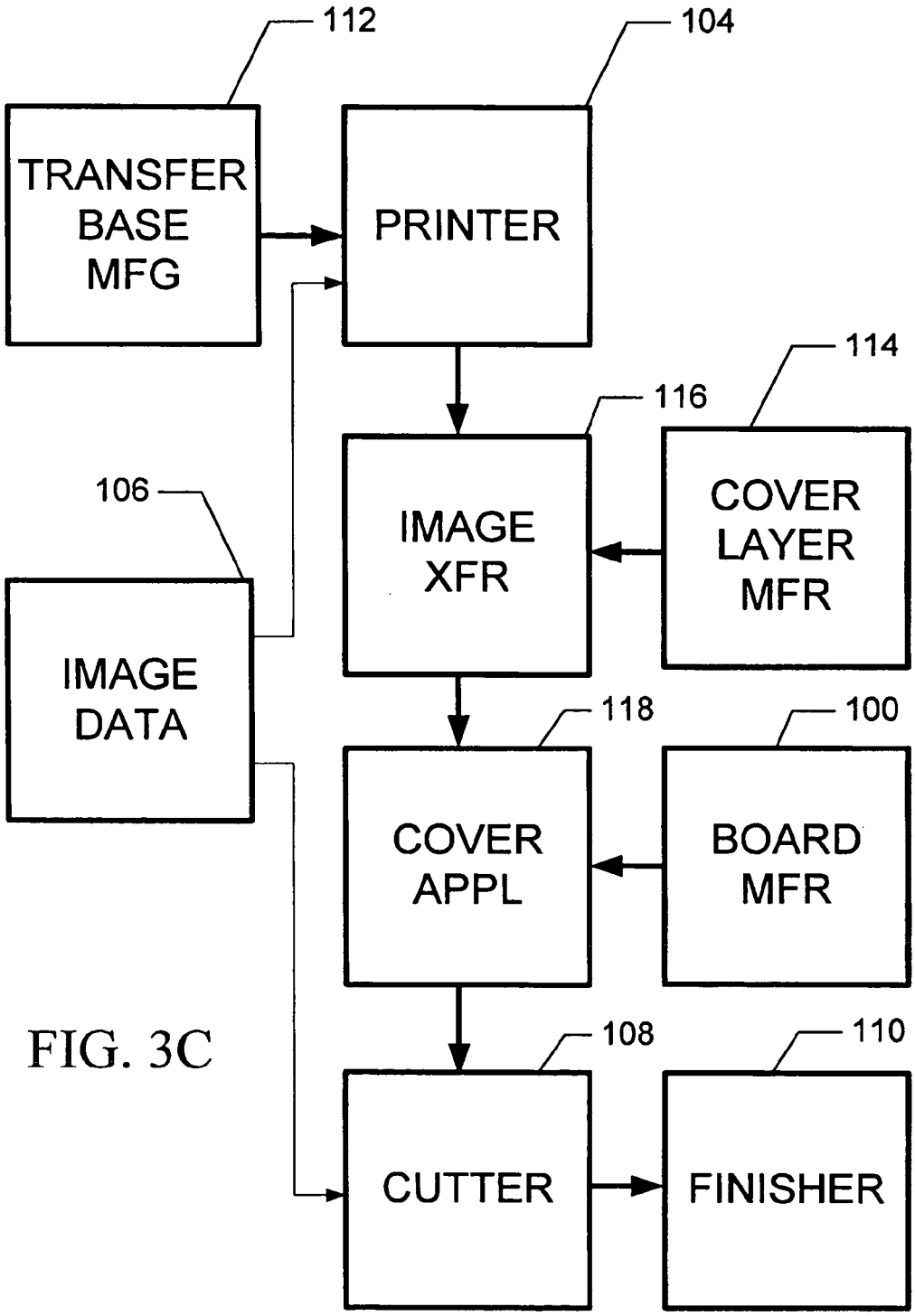

The basic steps in some exemplary production processes are illustrated in FIGS. 3A–C. As reflected in FIG. 3A, after forming the base board 10, a cover layer may be applied 102. The covered board may then be fed into a printer unit 104 wherein a pattern corresponding to an image data file 106 is applied to the cover layer to form a decorative image and typically at least two predetermined alignment marks 16*a*, 16*b*. The covered and printed board may then be fed into a cutter unit 108. The cutter unit, using the same image data file 106, will then locate the alignment marks 16*a*, 16*b* and, depending on the configuration of the cutting device, adjust the alignment of the board relative to the cutter or, based on the detected misalignment, adjust the image data.

In the exemplary embodiment illustrated in FIG. 3B, after forming the base board 10, a primer layer may be applied 103 to all or a predetermined portion of the board surface. Depending on the composition and application weight of the primer layer, various properties of the underlying board 10, such as acoustical performance, the smoothness and/or the print receptiveness, may be modified to improve the completed panel product. The primed board may then be fed into a printer unit 104 where a pattern corresponding to an image data file 106 is applied to the cover layer to form a decorative image and the predetermined alignment marks. The covered and printed board may then be fed into a cutter unit 108.

Another alternative embodiment using an image transfer process is illustrated in FIG. 3C. As shown in FIG. 3C, the image data 106 is used to print a reversed image on premanufactured transfer base 112, such as paper or other suitable material. The image formed on the transfer base is then transferred to a premanufactured cover layer material 114, such as a polymeric veil, in a transfer step 116 that typically utilizes a combination of pressure and temperature to form the desired image on the cover layer. The cover layer and the integral image are then applied to the board or other base substrate in an application process 118. The covered and printed board may then be fed into a cutter unit 108 where the waste portions of the board are removed, after which the trimmed board may be fed into one or more finishers 110 to complete the production of the final board product.

Figure 4A:
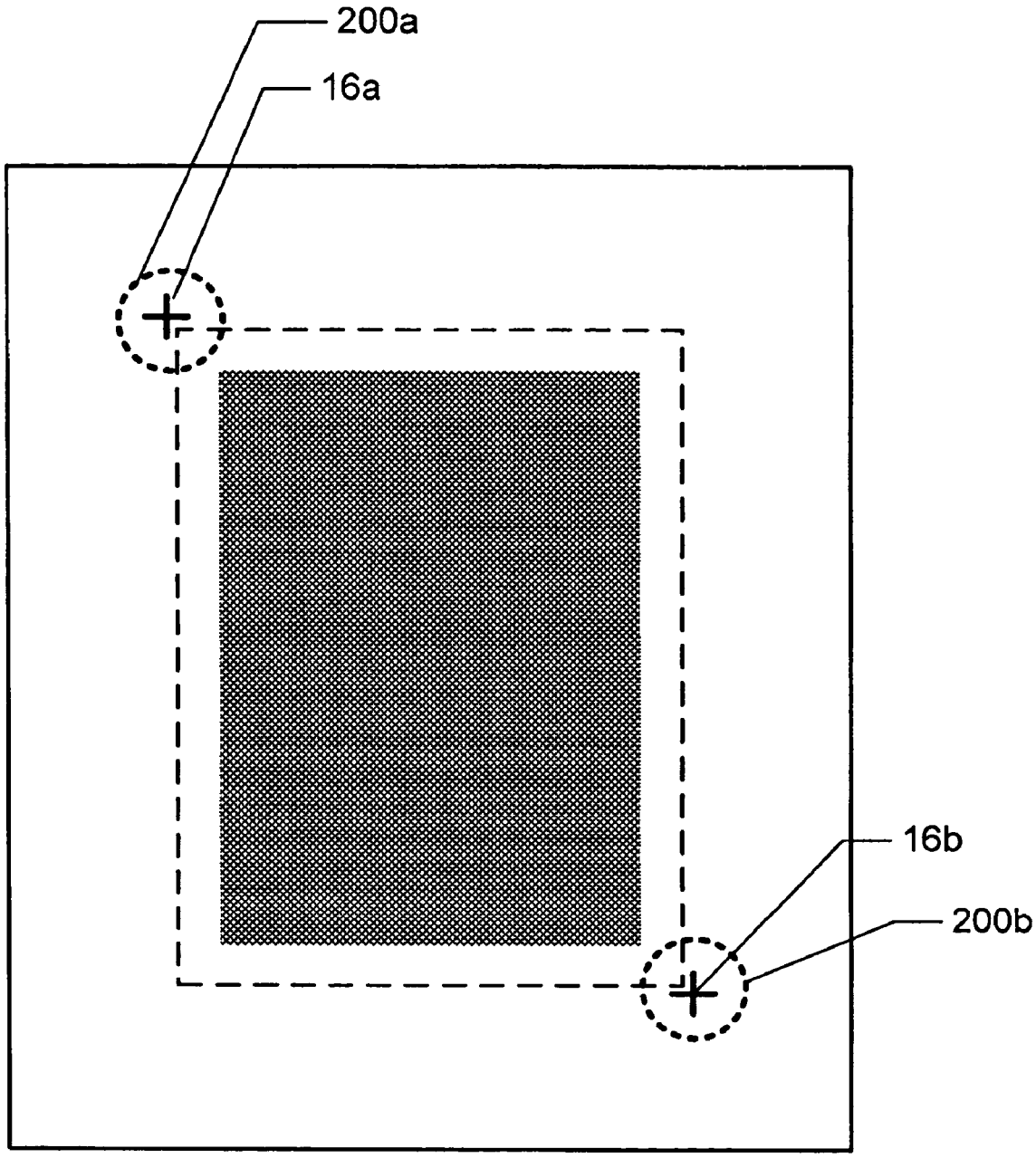
FIGS. 4A–D illustrate the alignment operation utilizing the alignment marks during the cutting operation in the production of the final panel product for two exemplary embodiments.
Figure 4B:
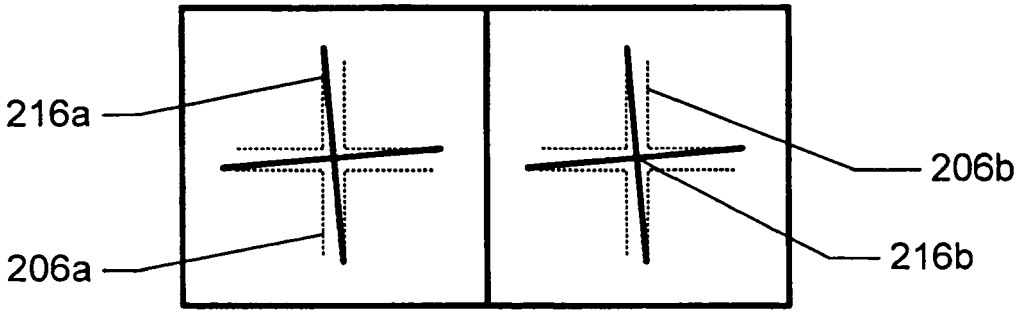

As illustrated in FIG. 4A, the cutting apparatus will include optical units that are arranged and configured to scan predetermined regions 200*a*, 200*b* of a roughly aligned board 10 in which the various alignment marks 16*a*, 16*b* are expected to be found. Once the alignment marks are located, their alignment will be checked against target images 206*a*, 206*b* corresponding to the image data 106 to determine if the board 10 is sufficiently aligned for further processing, typically cutting, or if, as illustrated in FIG. 4B, some alignment correction between the board and the image pattern is required. Depending on the particular apparatus used, detected misalignment may be corrected by shifting the board relative to the apparatus to reposition the alignment marks 216*a*', 216*b*' relative to the image pattern in order bring the board into acceptable alignment, FIG. 4C, or the X-Y coordinate pattern used for controlling the cutting device may be transformed to correct for the detected misalignment with the transformed image pattern 206*a*', 206*b*', thereby allowing the pattern to be cut accurately without altering the position of the board.

Figure 4C:
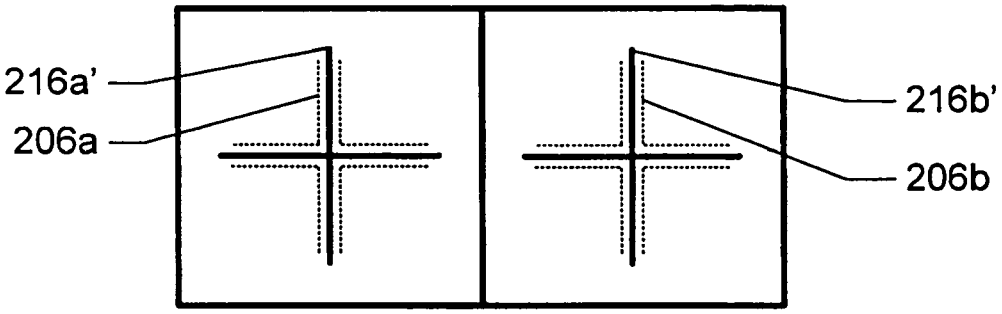
Figure 4D:
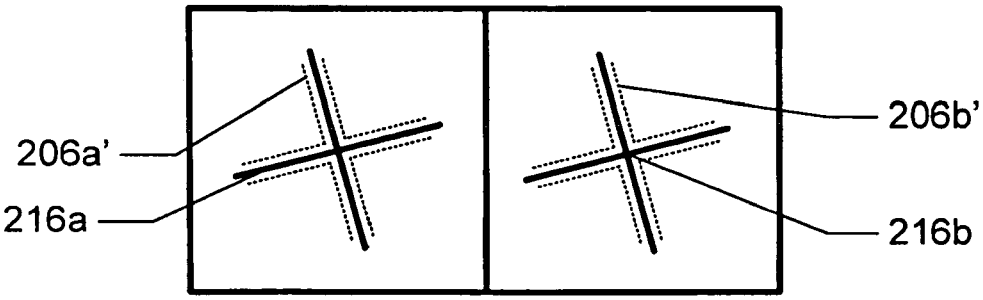

In the first exemplary embodiment, the cutter device bed will include manipulators arranged and configured for making fine positional adjustments to the board whereby a sufficiently aligned orientation between the detected alignment marks 216*a*', 216*b*' and the target positions 206*a*, 206*b* identified from image data file, FIG. 4C, may be achieved, before beginning the actual cutting or other alteration of the board and/or cover layer according to the image data file.

In the second exemplary embodiment, the degree of misalignment, the board is maintained in a relatively fixed position as both translational and/or rotational component(s) of the misalignment will be analyzed and used to generate a transformed image data file 206' that compensates for the detected misalignment. The transformed image data file will typically include modified alignment targets 206*a*', 206*b*' for confirming the correlation between pattern image that will be used to guide the cutter or other tool and the detected alignment marks 216. While maintaining the board 10 in the original position, the transformed image data file will be used to guide the cutting tool(s) across the board thereby substantially compensating for the detected misalignment.

Once sufficient alignment between the board and the image data pattern has been established, the cutter unit or other tool may be operated as described above to produce an intermediate panel product. The intermediate panel product may then be fed into one or more finishing unit or finishers 110 that may be used to complete the edge formation through operations, including, for example, cutting, folding or other compression of predetermined regions of the board 10, overlapping and adhesion of excess covering layer material or other premanufactured layers and/or edge profile shaping to provide additional decorative features and/or cooperate with a designed panel mounting system including, for example, frames for holding suspended ceiling tiles.

Figure 5A:
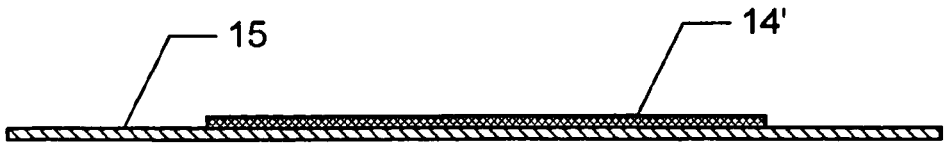
FIGS. 5A–D illustrate the fabrication of a decorative panel embodiment generally conforming to FIG. 1B using an image transfer method.
Figure 5B:
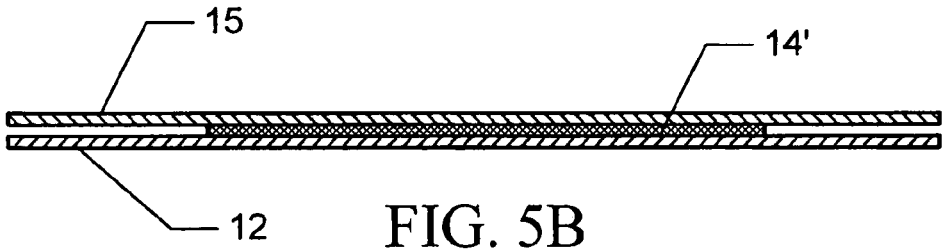
Figure 5C:
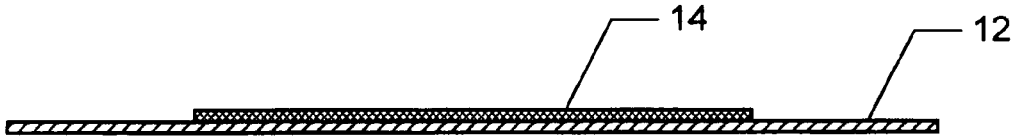
Figure 5D:
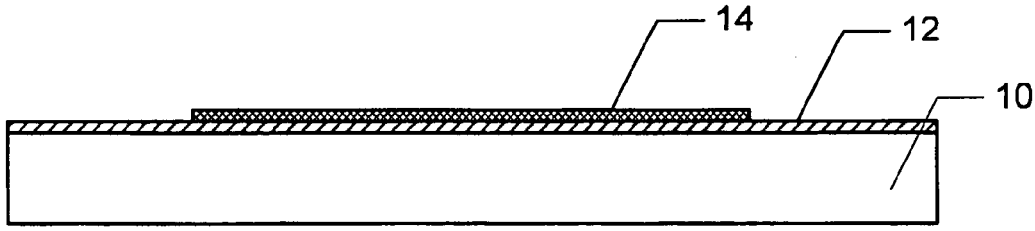

Certain of the steps outlined in the exemplary process illustrated in FIG. 3C are further detailed in FIGS. 5A–D. As illustrated in FIG. 5A, a reversed image 14' is formed on a transfer material 15 such as paper or other suitable material. The reversed image is then brought into contact with the material 12 that will carry the final image such as a premanufactured film, layer, veil or cover layer, typically formed from one or more polymeric materials. Application of pressure and/or increased temperature is then used to transfer a substantial portion of the reversed image 14' onto a surface of the receiving material 12. The receiving material, now carrying the intended image 14, may then be applied to a board 10 or other suitable substrate and subjected to some or all of the additional processing described previously.

While the present invention has been particularly shown and described with reference to exemplary embodiments thereof, it will be understood by those of ordinary skill in the art that various changes in form and details may be made therein without departing from the spirit and scope of the present invention as defined by the following claims. In particular, it will be appreciated that a range of known conveying mechanisms may be used to achieve the desired positioning and movement of the fiber batt or batts as they advance through the apparatus. Similarly, it will be appreciated that the sequence and timing for coating the various surfaces of the fiber batts may be modified to accommodate a wide range of fiber and coating material combinations.

What is claimed is:

1. A method for forming decorative panel products comprising:

preparing a substrate from a material selected from the group of glass fibers, mineral fibers, polymeric fibers, polymeric foams and mixtures thereof;

applying a decorative image and alignment marks corresponding to an image data file to a surface of the substrate to form a printed substrate;

detecting the alignment marks;

aligning the printed substrate with a cutting device using the detected alignment marks; and driving the cutting device using the image data file to cut the printed substrate and produce a panel preform.

2. A method for forming decorative panel products according to claim 1, further comprising:

modifying edge surfaces of the panel preform to form a finished panel product.

3. A method for forming decorative panel products according to claim 1, further comprising:

applying a premanufactured cover layer to at least a portion of a major surface of the substrate; and printing the decorative image and alignment marks corresponding to the image data file on the premanufactured cover layer to form the printed substrate.

4. A method for forming decorative panel products according to claim 1, further comprising:

applying a primer layer to at least a portion of a major surface of the substrate; and printing the decorative image and alignment marks corresponding to the image data file on the primer layer to form the printed substrate.

5. A method for forming decorative panel products according to claim 1, further comprising:

applying the decorative image and alignment marks corresponding to the image data file on a cover layer to form a printed cover layer; and applying the printed cover layer to the surface of the substrate to form the printed substrate.

6. A method for forming decorative panel products according to claim 5, further comprising:

applying a reversed decorative image and reversed alignment marks corresponding to the image data file to a transfer base to form an image layer on the transfer base;

bringing the image layer into contact with said cover layer;

transferring the majority of the image layer from the transfer to the cover layer to form the decorative image and alignment marks on the printed cover layer; and applying the printed cover layer to the surface of the substrate to form the printed substrate.

7. A method for forming decorative panel products according to claim 1, further comprising:

forming a protective layer on the decorative image.

8. A method for forming decorative panel products comprising:

preparing a substrate;

applying a decorative image and alignment marks corresponding to an image data file to a surface of the substrate to form a printed substrate;

detecting the alignment marks;

aligning the printed substrate with a cutting device using the detected alignment marks; and driving the cutting device using the image data file to cut the printed substrate and produce a panel preform wherein aligning the printed substrate with a cutting device using the detected alignment marks includes comparing an observed positioning of the detected alignment marks with an expected positioning of the detected alignment marks corresponding to the image data file;

adjusting the position of the printed substrate relative to the cutting device; and repeating the comparing and adjusting steps until the observed positioning of the detected alignment marks is in sufficient correspondence with the expected positioning of the detected alignment marks.

9. A method for forming decorative panel products comprising:

preparing a substrate from a material selected from the group of glass fibers, mineral fibers, polymeric fibers, polymeric foams and mixtures thereof;

printing a decorative image and alignment marks corresponding to an image data file on a surface of the substrate to form a printed substrate;

detecting the alignment marks;

generating a transformed image data file using the detected alignment marks; and driving the cutting device using the transformed image data file to cut the printed substrate and produce a panel preform.

10. A method for forming decorative panel products according to claim 9, further comprising:

modifying edge surfaces of the panel preform to form a finished panel product.

11. A method for forming decorative panel products according to claim 9, further comprising:

applying a premanufactured cover layer to at least a portion of a major surface of the substrate; and printing the decorative image and alignment marks corresponding to the image data file on the premanufactured cover layer to form the printed substrate.

12. A method for forming decorative panel products according to claim 9, further comprising:

applying a primer layer to at least a portion of a major surface of the substrate; and printing the decorative image and alignment marks corresponding to the image data file on the primer layer to form the printed substrate.

13. A method for forming decorative panel products according to claim 9, further comprising:

applying the decorative image and alignment marks corresponding to the image data file on a cover layer to form a printed cover layer; and applying the printed cover layer to the surface of the substrate to form the printed substrate.

14. A method for forming decorative panel products according to claim 13, further comprising:

applying a reversed decorative image and reversed alignment marks corresponding to the image data file to a transfer base to form an image layer on the transfer base;

bringing the image layer into contact with a cover layer;

transferring the majority of the image layer from the transfer to the cover layer to form the decorative image and alignment marks on the printed cover layer; and applying the printed cover layer to the surface of the substrate to form the printed substrate.

15. A method for forming decorative panel products according to claim 9, further comprising:

forming a protective layer on the decorative image.

16. A method for forming decorative panel products comprising:

preparing a substrate;

printing a decorative image and alignment marks corresponding to an image data file on a surface of the substrate to form a printed substrate;

detecting the alignment marks;

generating a transformed image data file using the detected alignment marks; and driving the cutting device using the transformed image data file to cut the printed substrate and produce a panel preform wherein aligning the printed substrate with a cutting device using the detected alignment marks includes comparing an observed positioning of the detected alignment marks with an expected positioning of the detected alignment marks corresponding to the image data file;

preparing the transformed image data file by adjusting the expected positioning of the detected alignment marks relative to the printed substrate;

comparing the observed positioning of the detected alignment marks with an updated expected positioning of the detected alignment marks corresponding to the transformed image data file;

repeating the preparing and comparing steps until the observed positioning of the detected alignment marks is in sufficient correspondence with the expected positioning of the detected alignment marks.

* * * * *